US005131639A

United States Patent [19]

Nonaka

[11] Patent Number: 5,131,639

[45] Date of Patent: Jul. 21, 1992

[54] BACKING PLATE RETAINER

[75] Inventor: Hideo Nonaka, Kurobe, Japan

[73] Assignee: Yoshida Kogyo K.K., Tokyo, Japan

[21] Appl. No.: 633,988

[22] Filed: Dec. 26, 1990

[30] Foreign Application Priority Data

Dec. 26, 1989 [JP] Japan ..... 1-337255

[51] Int. Cl.[5] ..... B42B 5/02

[52] U.S. Cl. ..... 269/292; 269/909; 227/15; 83/451

[58] Field of Search ..... 269/289 R, 8, 291, 292, 269/309, 900; 29/281.1; 112/114; 83/451; 227/15, 31, 154

[56] References Cited

U.S. PATENT DOCUMENTS

| | | | |
|---|---|---|---|
| 3,220,628 | 11/1965 | Boshier | 227/15 |
| 3,237,832 | 3/1966 | Wilson | 227/117 |
| 3,358,895 | 12/1967 | Chiabrandy | 227/15 |
| 4,789,089 | 12/1988 | Toyota | 227/15 |

FOREIGN PATENT DOCUMENTS

| | | |
|---|---|---|
| 58-110022 | 7/1983 | Japan . |
| 61-180125 | 11/1986 | Japan . |
| 799495 | 8/1958 | United Kingdom . |
| 827456 | 2/1960 | United Kingdom . |
| 2048649 | 12/1980 | United Kingdom . |
| 2067452 | 7/1981 | United Kingdom . |

*Primary Examiner*—Bruce M. Kisliuk
*Assistant Examiner*—Eileen Morgan
*Attorney, Agent, or Firm*—Hill, Van Santen, Steadman & Simpson

[57] ABSTRACT

A backing plate retainer is disclosed for retaining a backing plate for clamping engagement with a fastening element such as a hook and eye fastener. The retainer includes an adapter strip of a given width which is remotely attached to at least one of its longitudinal edges. The retainer has magnetic members adapted to attract and hold the adapter strip in place with respect to the retainer.

8 Claims, 4 Drawing Sheets

BACKING PLATE RETAINER

BACKGROUND OF THE INVENTION

1. Field of the Invention

This invention relates generally to an apparatus for applying fastening elements such as cooperating hook and eye members onto garment articles like slacks, shirts and the like. The invention relates more particularly to a backing plate retainer means used in such apparatus.

2. Prior Art

Assembling of hook and eye fasteners in textile materials such as for example of slacks is usually effected with use of a retainer plate carrying thereon a backing plate and adapted to be inserted through an opening or pocket formed between a waistband and a fly strip, in which instance the hook or eye member is brought into clamping engagement with the backing plate to secure the textile material therebetween by means of a punch and die unit.

Typical examples of a retainer plate of the type described are disclosed in Japanese Laid-Open Utility Model Publications Nos. 61-180125 and 58-110022.

Since belts for slacks widely vary in size, particularly in width and hence waistbands vary accordingly, it is necessary to change the retainer plates each time to fit with the particular waistband so as to ensure proper positioning of the hook or eye member thereon.

The retainer plates disclosed and taught in the aforementioned prior art devices are fixedly connected to their support frames and therefore tedious and time-consuming procedures are required to remove existing retainer plates from and assemble new ones on the machine each time the hook or eye members are applied to waistbands of different widths.

SUMMARY OF THE INVENTION

It is a primary object of the present invention to provide an improved backing plate retainer means for use in the assembling of fastening elements such as hook and eye members on garments which will eliminate or alleviate the foregoing drawbacks of the prior art.

More specifically, the present invention seeks to provide an improved backing plate retainer means which incorporates such structural and functional features that will enable replacement of retainer means with utmost ease and efficiency.

According to the invention, there is provided a backing plate retainer means for use in applying fastening elements onto garments which comprises a generally rectangular retainer plate having a recess for retaining therein a backing plate and an adapter strip removably attached to and along at least one of opposite longitudinal edges of the retainer plate.

The above and other objects and features of the invention will appear clear from the following detailed description taken with reference to the accompanying drawings which illustrate by way of example a preferred embodiment. Like reference numerals refer to like or corresponding parts throughout the several views.

DETAILED DESCRIPTION OF THE INVENTION

Figure 3:
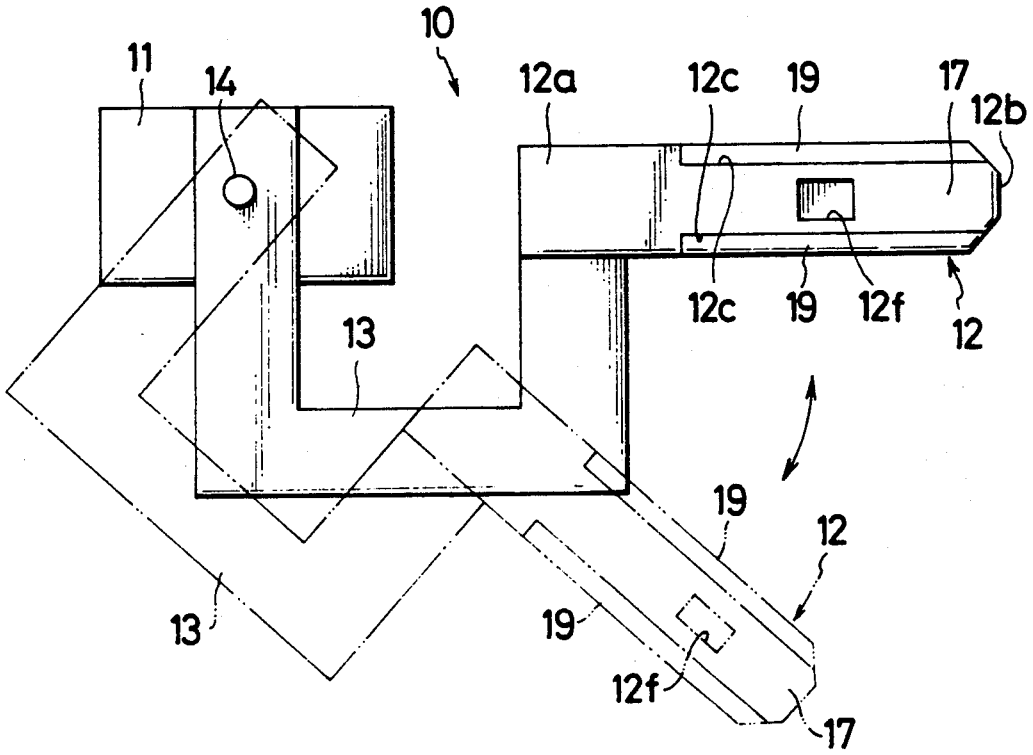
FIG. 3 is a plan view of the retainer means shown mounted in a hook applying apparatus.
Figure 4:
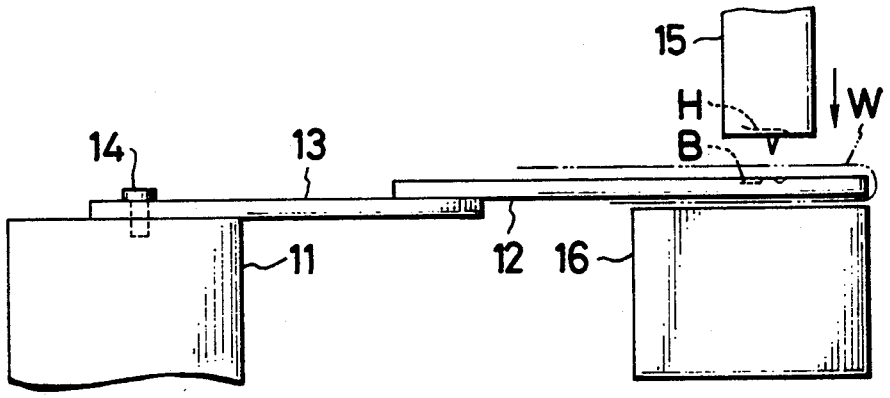
FIG. 4 is a side elevational view of the same.

Referring now to the drawings and firstly FIGS. 3 and 4, there is schematically shown an apparatus 10 for applying a hook component H of a fastener onto a stacks waistband W. The apparatus 10 comprises a pedestal 11, a backing plate retainer means 12 and a crank arm 13 having one of its ends pivotally connected by pin 14 to the pedestal 11 and the opposite end fixedly connected to one end of the retainer means 12. The apparatus 10 further includes a punch 15 and a die 16, the punch 15 being vertically movable to clamp and anchor the hook component H together with a backing plate B in the textile material of the waistband W in a manner well known in the art as depicted in FIG. 4.

Figure 1:
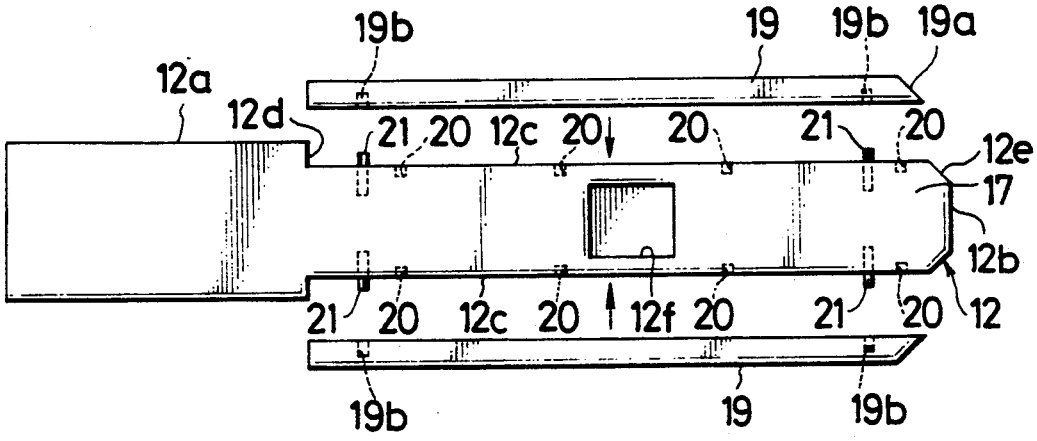
FIG. 1 is a plan view of a retainer means embodying the invention for use in applying a hook component of a fastener.
Figure 7:
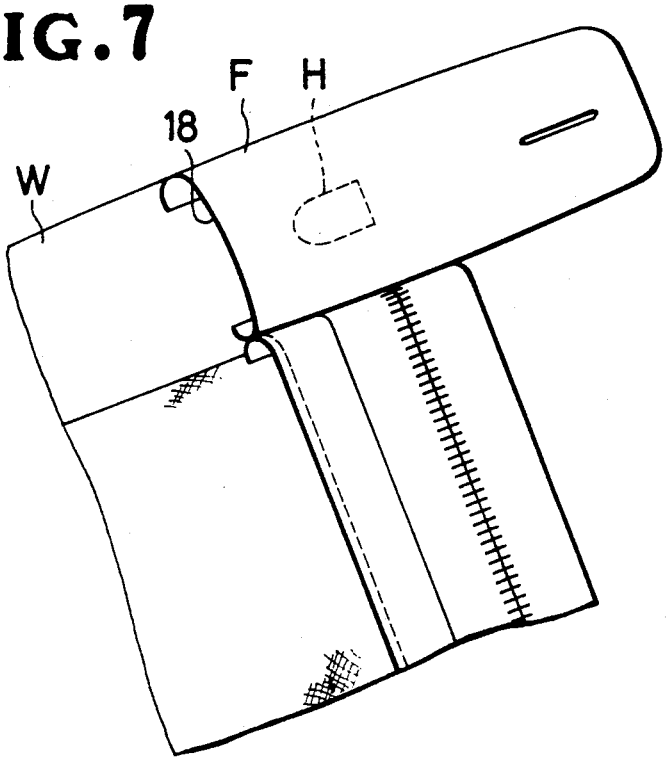
FIG. 7 is a perspective view of a waistband portion of a garment showing a hook attached thereon.
Figure 9:
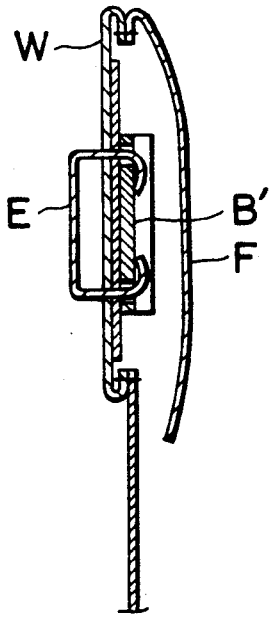
FIG. 9 is a cross-sectional view on enlarged scale of the waistband portion shown in FIG. 8.
Figure 8:
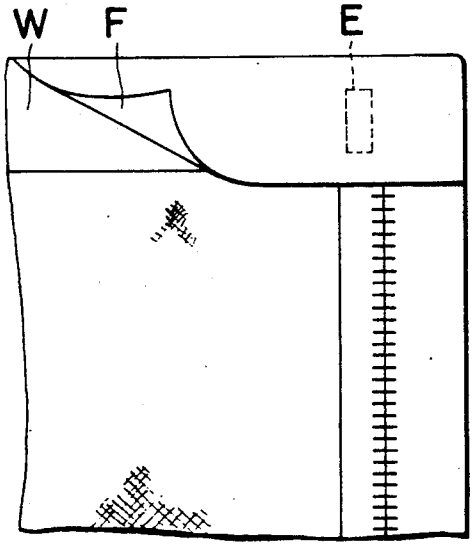
FIG. 8 is a plan view of a waistband portion of a garment showing an eye attached thereon.

The retainer means 12 embodying the invention for use in applying the hook component H, as shown in FIG. 1, is in the form of an elongated rectangular retainer plate 17 having a connecting end portion **12*a* connected to the crank arm 13 and a free end portion 12*b* adapted to be inserted into an opening or pocket 18 (FIG. 7**) formed between the waistband W and an underlying fly strip F of slacks S.

The retainer plate 17 has both of its opposite longitudinal edges **12*c*, 12*c* recessed or offset as at 12*d*, 12*d* from the side surfaces of the connecting end portion 12*a* and inwardly canted at the free end portion 12*b* to provide tapered corners 12*e*, 12*e* which serve to facilitate the insertion of the retainer means 12 into the pocket 18 of the waistband W. Although the longitudinal edges 12*c*, 12*c* of the retainer plate 17 are thus shown preferably to be recessed or offset, they may be coextensive with respective longitudinal edges of the connecting end portion 12*a***.

Figure 2:
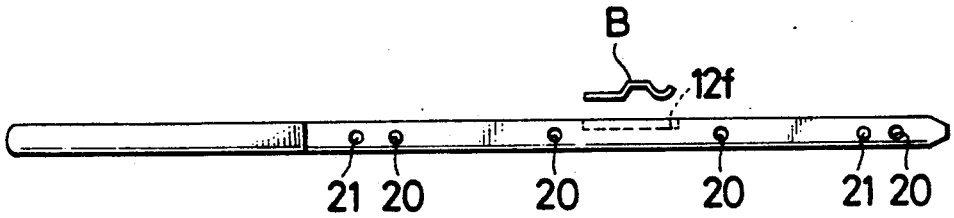
FIG. 2 is a side view of the retainer means of FIG. 1.

The retainer plate 17 is provided in its upper surface with a receiving recess or cavity **12*f* for temporarily accommodating a backing plate B (FIG. 2) until it is clamped together with the hook component H by the unit of punch and die 16**.

According to an important aspect of the invention, there is provided an adapter strip 19 preferably made of a metallic material and dimensioned to fit with and along either of the longitudinal edges **12*c*, 12*c* and having a predetermined width. For the retainer means 12 designed for applying the hook component H, a pair of adapter strips 19, 19 are preferably provided for attachment as better shown in FIG. 1. Each adapter strip 19 has a tapered end 19*a* canted at an angle to register in alignment with the tapered corner 12*e* of the retainer plate 17 when assembled as shown in FIG. 3**.

In order to facilitate attachment of the adapter strip 19 to the retainer plate 17, there are provided a plurality of magnetic members 20 which are embedded to lie substantially flush with the contour of the longitudinal edge 12*c* of the retainer plate 17 and which are adapted to attract and hold the adapter strip 19 in place with respect to the retainer plate 17.

A plurality of positioning prongs 21 extend laterally from the longitudinal edges 12*c* of the retainer plate 17 and are engageable with corresponding recesses 19*b* in the adapter strip 19, the arrangement being to ensure proper alignment between the retainer plate 17 and the adapter strip 19.

Figure 5:
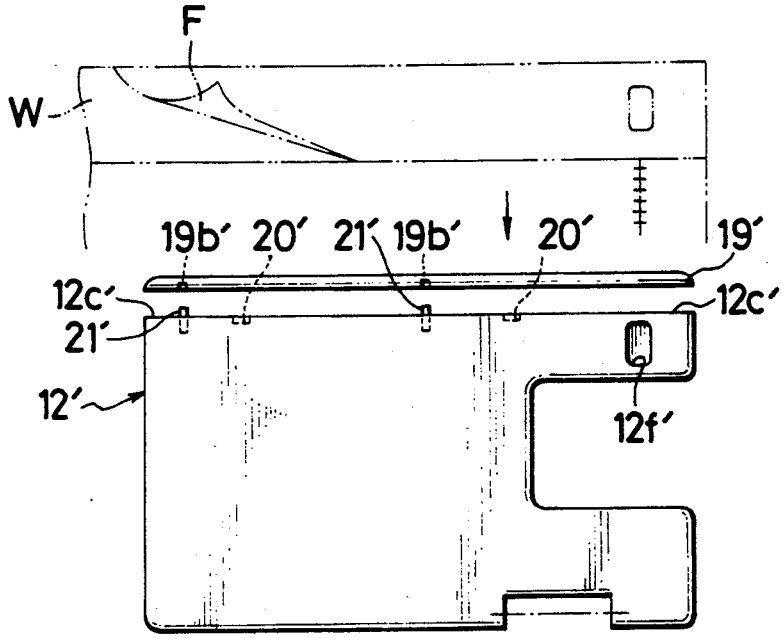
FIG. 5 is a plan view of a retainer means embodying the invention for use in applying an eye component of the fastener.
Figure 6:
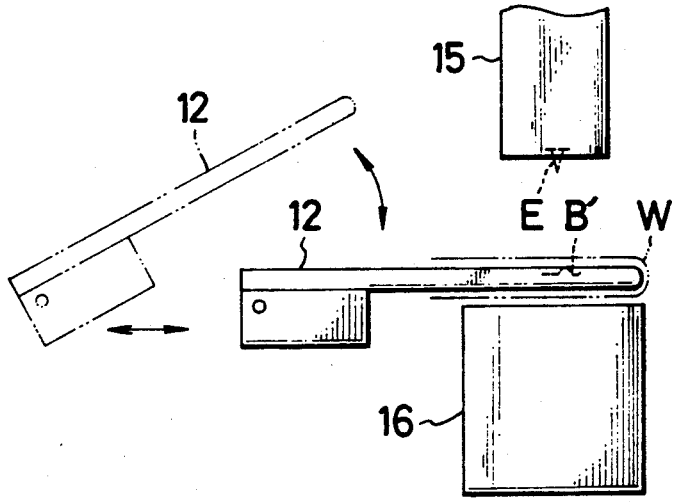
FIG. 6 is a side elevational view of the retainer means shown mounted in an eye applying apparatus.

Reference to FIGS. 5 and 6, there is shown an apparatus 10' for applying an eye component E of a fastener onto a stacks waistband W. A backing plate retainer means 12' is supported for both rotary and linear movement with respect to the unit of punch 15 and die 16 as shown in FIG. 6.

The retainer means 12' is in the form of a generally rectangular retainer plate 17' having a receiving recess or cavity 12*f'* for temporarily accommodating a backing plate B' until it is clamped together with the eye E. Similarly to the retainer means 12 for applying the hook component H, the retainer plate 17' has magnetic members 20' and prongs 21' provided along one of its longitudinal edges 12*c'* and is engageable with an adapter strip 19' for the purpose already described.

The waistband W is brought into working position with respect to the apparatus 10' by fitting the same sidewise through its opening 18' over the retainer means 12'.

Advantageously, there may be stored a suitable number of adapter strips 19, 19' having different widths which may be chosen at will to match any given widths of waistbands W and easily attached to the retainer plate 17, 17' for applying hook and/or eye components of a fastener accurately and efficiently onto the waistbands W.

Obviously, various modifications and variations of the present invention are possible in the light of the above teaching. It is therefore to be understood that within the scope of the appended claims the invention may be practiced otherwise than as specifically described.

What is claimed is:

1. A backing plate retainer means for use in applying fastening elements onto garments which comprises a generally rectangular retainer plate having a recess for retaining therein a backing plate and an adapter strip removably attached to and along at least one of opposite longitudinal edges of said retainer plate, said retainer plate having a plurality of magnetic members lying flush with said retainer plate longitudinal edge to attract and hold said adapter in place with respect to said retainer plate.

2. A backing plate retainer means according to claim 1 wherein said adapter strip is removably attached to and along each of opposite longitudinal edges.

3. A backing plate retainer means according to claim 2 wherein the longitudinal edge of said retainer plate is offset from an end portion of said retainer plate.

4. A backing plate retainer means according to claim 2 wherein said retainer plate has a tapered corner at its free end portion and said adapter strip has a tapered end canted at an angle to register in alignment with said tapered corner.

5. A backing plate retainer means for use in applying fastening elements onto garments which comprises a generally rectangular retainer plate having a recess for retaining therein a backing plate and an adapter strip removably attached to and along at least one of opposite longitudinal edges of said retainer plate, said retainer plate having a plurality of positioning prongs extending laterally from said retainer plate longitudinal edge and said adapter strip having corresponding recesses for receptive engagement with said prongs.

6. A backing plate retainer mans according to claim 5 wherein said adapter strip is removably attached to and along each of opposite longitudinal edges.

7. A backing plate retainer means according to claim 6 wherein the longitudinal edge of said retainer plate is offset from an end portion of said retainer plate.

8. A backing plate retainer means according to claim 6 wherein said retainer plate has a tapered corner at its free end portion and said adapter strip has a tapered end canted at an angle to register in alignment with said tapered corner.

* * * * *